United States Patent [19]

Miyazaki

[11] Patent Number: 4,721,263

[45] Date of Patent: Jan. 26, 1988

[54] DEVICE FOR AUTOMATICALLY STRIPPING AND DELIVERING FORE END OF A PAPER ROLL

[75] Inventor: Masaru Miyazaki, Tokyo, Japan

[73] Assignee: Japan Tobacco, Inc., Japan

[21] Appl. No.: 820,882

[22] Filed: Jan. 17, 1986

[30] Foreign Application Priority Data

Jan. 28, 1985 [JP] Japan ..... 60-9167[U]

[51] Int. Cl.[4] ..... B65H 19/00

[52] U.S. Cl. ..... 242/55; 242/78.8

[58] Field of Search ..... 242/55, 58.4, 78.8; 226/91, 92

[56] References Cited

U.S. PATENT DOCUMENTS

| | | | |
|---|---|---|---|
| 2,494,399 | 1/1950 | McCleary | 242/78.8 |
| 2,965,328 | 12/1960 | Groll | 242/78.8 |
| 3,010,672 | 11/1961 | Cecil | 242/78.8 |
| 3,712,554 | 1/1973 | Lorenzini et al. | 242/56.2 |
| 3,728,197 | 4/1973 | Harris et al. | 242/58.4 |
| 3,782,664 | 1/1974 | Alberto | 242/58.4 |
| 4,278,489 | 7/1981 | Horsley | 242/57 |
| 4,579,293 | 4/1986 | Steiniger | 226/92 X |

FOREIGN PATENT DOCUMENTS

| | | |
|---|---|---|
| 2442786 | 6/1980 | France . |
| 2483269 | 12/1981 | France . |
| 2091224 | 7/1982 | United Kingdom . |

*Primary Examiner*—Stuart S. Levy
*Assistant Examiner*—Katherine Matecki
*Attorney, Agent, or Firm*—Lowe, Price, LeBlanc, Becker & Shur

[57] ABSTRACT

A device for automatically stripping and delivering a fore end of a paper roll, in which the fore end of the paper roll, which is wound on a bobbin, is gripped by both a stripping lever and a pawl member when the paper roll fore end gets on the fore end portion of the stripping lever, the stripping lever being capable of coming into contact with and moving away from the paper roll, the pawl member being mounted on a fore end side of the stripping member so as to be capable of coming into contact with and moving away from the fore end of the stripping member. The fore end of the paper roll after being stripped and drawn out by both the stripping member and the pawl member is sucked and delivered to the next step.

6 Claims, 11 Drawing Figures

DEVICE FOR AUTOMATICALLY STRIPPING AND DELIVERING FORE END OF A PAPER ROLL

BACKGROUND OF THE INVENTION

The present invention relates to a device for automatically stripping a leading end of a paper roll having a pasted portion and thereafter delivering the paper roll to the next step.

For example, a paper roll for the production of tobacco has a pasted portion (see FIG. 4) at a predetermined distance from a fore end thereof, and in setting the paper roll to a cutting and feeding device, its fore end is stripped and drawn out manually.

However, with the recent automation of the tobacco production line, it has become necessary to automate the delivery of a paper roll.

In view of such a necessity, various means have been proposed for automatic delivery of a paper roll. For example, it has been proposed to suck and draw out a fore or leading end of a paper roll by means of a suction head. In this case, a simple construction suffices in which the suction head is brought into abutment with the leading end of the paper roll and then separated therefrom. However, there has been the problem that if the pasting is not appropriate, the delivery of the paper roll cannot be done smoothly.

SUMMARY OF THE INVENTION

The present invention has been accomplished in view of the above circumstances. It is the object thereof to provide a device for automatically stripping and delivering a leading end of a paper roll which device is of a simple construction and capable of stripping a fore end of a paper roll without any trouble and delivering it to the next step.

In order to achieve the above-mentioned object, the device of the present invention is characterized by having a stripping lever capable of coming into contact with and moving away from a paper roll; a bobbin driving means for rotating a bobbin with the paper roll wound thereon so that a fore end of the paper roll gets on a fore end portion of the stripping lever; a pawl member mounted on a fore end side of the stripping member so as to be capable of coming into contact with and moving away from the fore end of the stripping member and gripping the fore end of the paper roll conjointly with the stripping member when the paper roll fore end gets on the fore end portion of the stripping lever; a stripping lever driving means for bringing the stripping lever into abutment with the paper roll and pivoting the stripping lever away from the paper roll after gripping the fore end of the paper roll by both the stripping lever and the pawl member; and a sucking and delivering means for sucking the fore end of the paper roll after being stripped and drawn out by both the stripping lever and the pawl member and delivering it to the next step.

BRIEF DESCRIPTION OF THE DRAWINGS

The accompanying drawings illustrate an embodiment of the present invention, in which.

DESCRIPTION OF A PREFERRED EMBODIMENT

An embodiment of the present invention will be described hereinunder with reference to the drawings.

Figure 1:
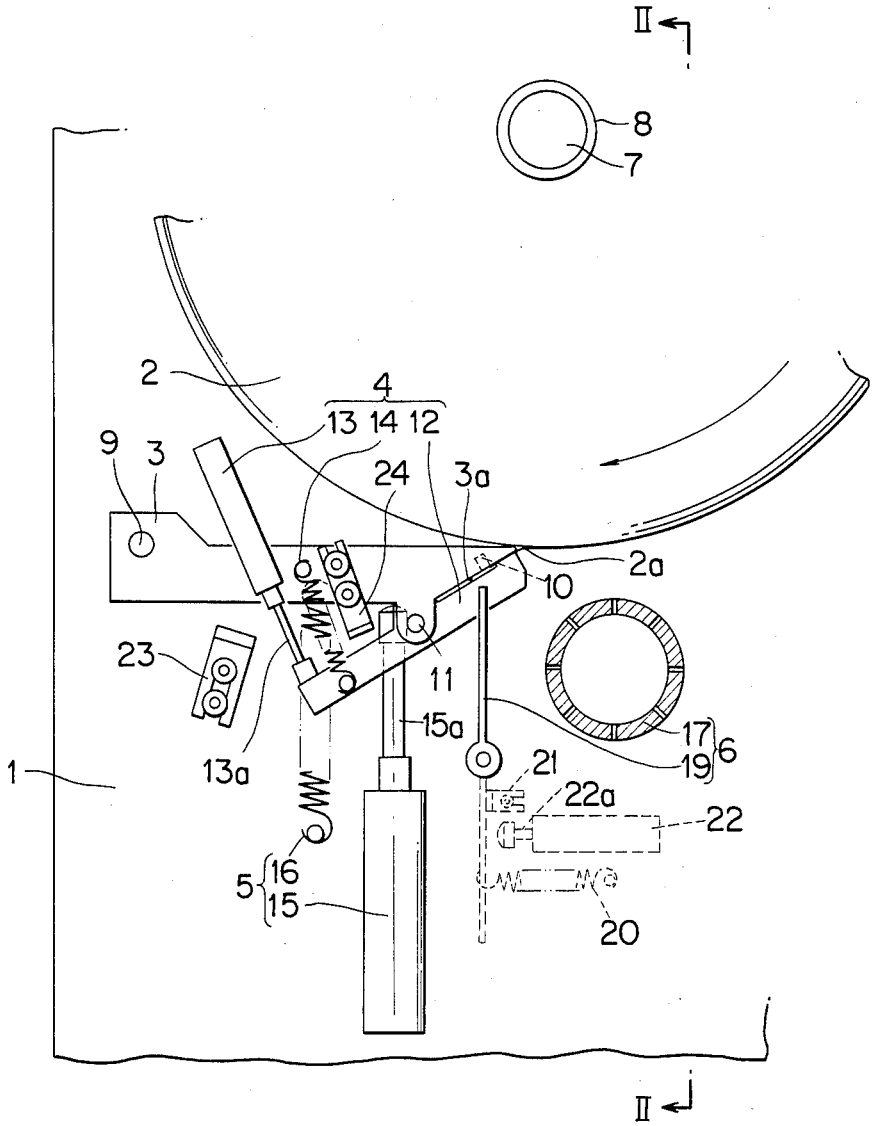
FIG. 1 is a side view of one embodiment of the present invention.
Figure 2:
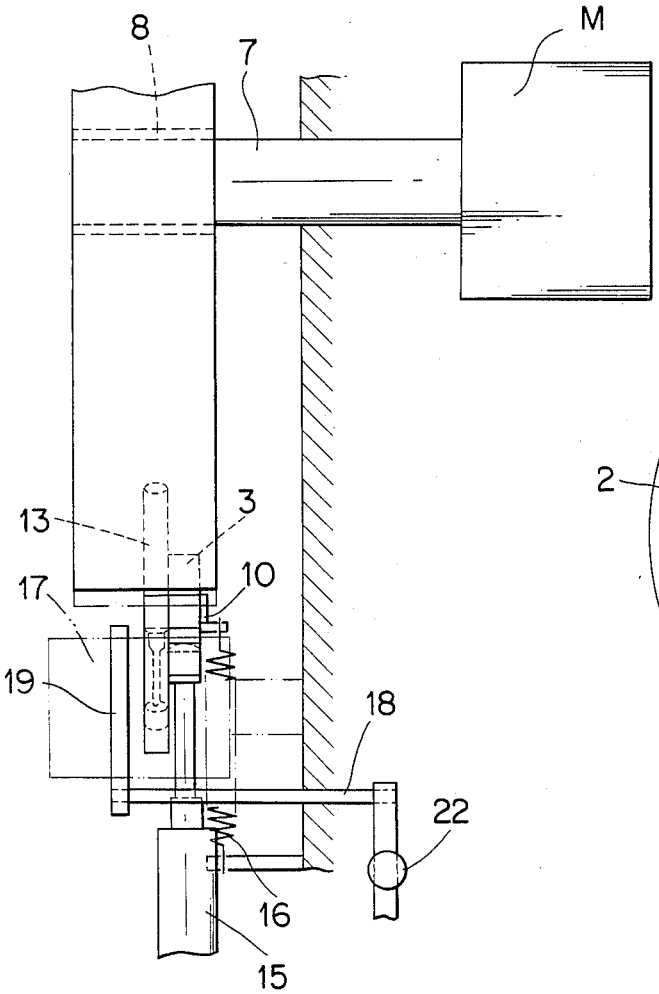
FIG. 2 is a view taken on line II—II of FIG. 1.

FIGS. 1 and 2 show an example of an automatic stripping and delivering device according to the present invention, in which the reference numerals 1, 2, 3, 4, 5 and 6 denote a base plate, a paper roll, a stripping lever, a pawl member, a stripping lever driving means and a sucking and delivering means, respectively.

A shaft 7 is attached rotatably to the base plate 1 and a paper roll bobbin 8 which is rotated by a motor M is mounted on the shaft 7.

The stripping lever 3 is attached to the base plate 1 in a position close to the paper roll 2 pivotably through a pin 9. Through its pivotal movements, the stripping lever 3 comes into contact with and moves away from the peripheral surface of the paper roll 2. At a fore end portion of the stripping lever 3 is formed an obliquely-cut inclined surface 3*a*, and a photoswitch 10 is embedded in the inclined surface 3*a*. The photoswitch 10 is for detecting a fore end 2*a* of the paper roll 2. It performs a switching operation when the fore end 2*a* gets on the inclined surface 3*a* and cuts off light incident on a light receiving surface (the portion of photoswitch 10 exposed from the inclined surface 3*a*).

The pawl member 4 is composed of a pawl piece 12 mounted on the fore end side of the stripping lever 3 through a pin 11 so that it can come into contact with and move away from the inclined surface 3*a*; an air cylinder 13 attached to the stripping lever 3 to move the pawl piece 12 pivotally so that a fore end of the pawl piece comes into abutment with the inclined surface 3*a*; and a coil spring 14 disposed between the pawl piece 12 and the stripping lever 3 to move the pawl piece 12 by virtue of its restoring resilience pivotally in a direction in which the fore end of the pawl piece 12 moves away from the inclined surface 3*a*.

The stripping lever driving means 5 is composed of an air cylinder 15 for pushing up the fore end portion of the stripping lever 3 and moving it pivotally toward the paper roll 2, and a coil spring disposed between the stripping lever 3 and the base plate 1 to move the stripping lever 3 by virtue of its restoring resilience pivotally in a direction in which the lever 3 is spaced form the paper roll 2.

The sucking and delivering means 6 is composed of a preliminary suction roller 17 disposed in a position close to the fore end portion of the stripping lever 3 to suck the fore end 2*a* of the paper roll 2 which has been stripped by the stripping lever 3 and the pawl member 4, and a spring plate 19 made of a spring material and attached to the base plate 1 pivotally through a pin 18 to push the fore end 2*a* of the paper roll against the preliminary suction roller 17. The spring plate 19 is maintained in a state (upright state) of abutment with a stopper 21 by means of a coil spring 20 and it is pivotally moved toward the preliminary suction roller 17 against the resilience of the said spring when an air cylinder 22 is in operation.

The numerals 23 and 24 denote stoppers for the stripping lever 3 and for the pawl piece 12, respectively.

The operation of the above automatic stripping and delivering device will be explained below with reference to FIGS. 3*a* to 3*h*.

Figure 3A:
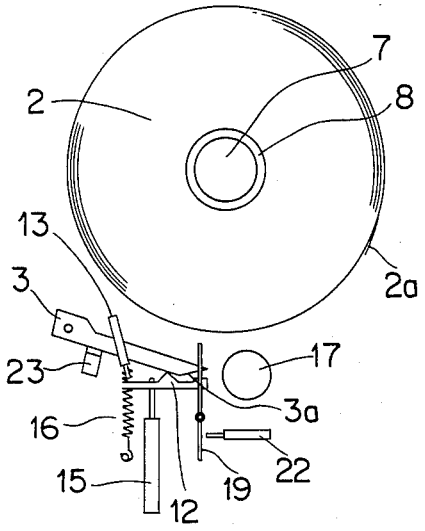
FIGS. 3*a* to 3*h* illustrate operations.
Figure 3B:
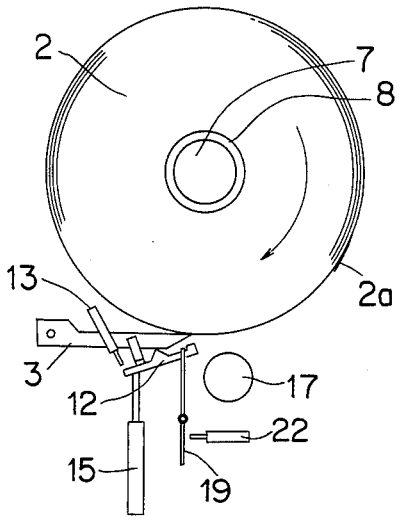
Figure 3C:
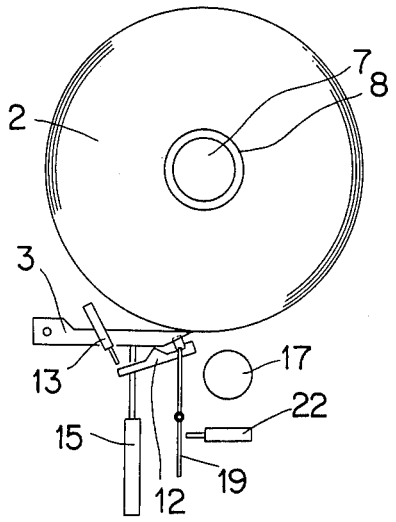
Figure 3D:
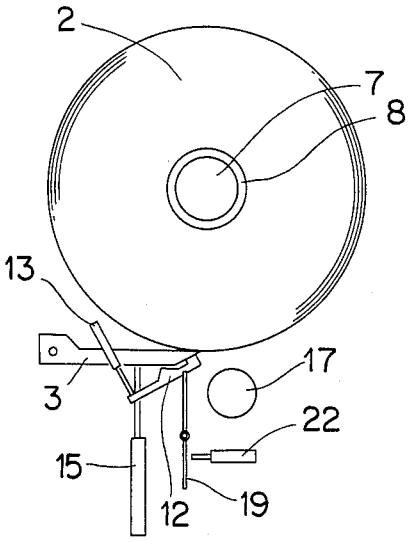
Figure 3E:
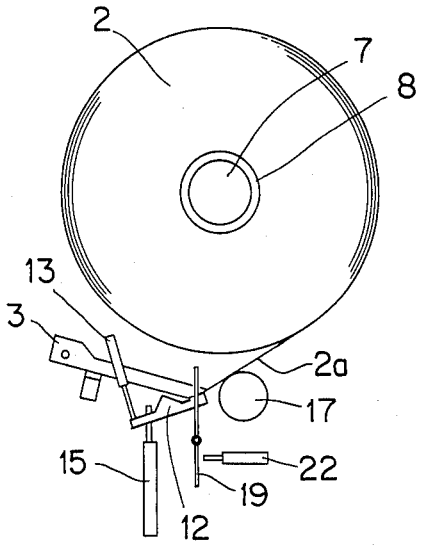
Figure 3F:
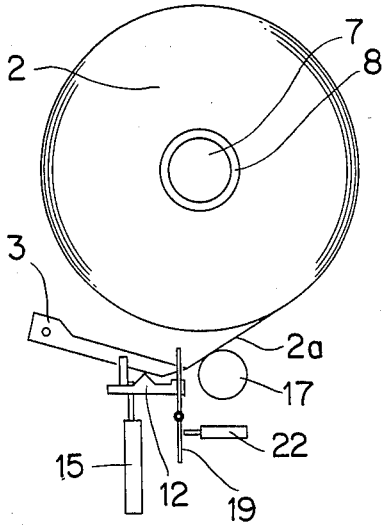

First, a piston 15*a* of the air cylinder 15 is extended from the state shown in FIG. 3*a* to pivot the stripping lever 3 against the resilience of the coil spring 16 until the fore end portion of the lever 3 abuts the peripheral surface of the paper roll 2 (see FIG. 3*b*).

Then, the paper roll 2 is rotated slowly in the arrowed direction in FIG. 3*b* by the motor M. When the fore end 2*a* of the paper roll gets on the inclined surface 3*a* and the photoswitch 10 detects it, the rotation of the paper roll 2 is stopped (see FIG. 3*c*). Thereafter, a piston 13*a* of the air cylinder 13 is extended to move the pawl piece 12 pivotally against the resilience of the coil spring 14 so that the fore end 2*a* is held between the fore end portion of the pawl piece 12 and the inclined surface 3*a* (see FIG. 3*d*).

Figure 4:
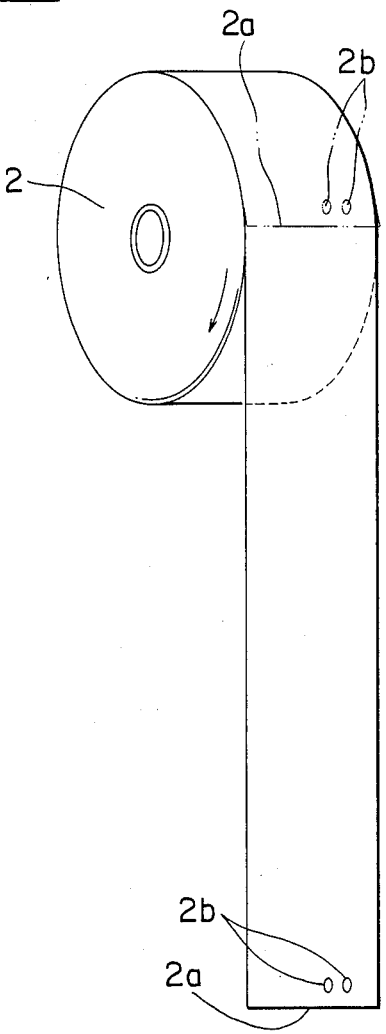
FIG. 4 is a perspective view of a paper roll.

Then, the piston 15*a* of the air cylinder 15 retracts so that by virtue of the restoring resilience of the coil spring 16 the stripping lever pivots away from the paper roll 2 while gripping the fore end 2*a* conjointly with the pawl member 4 and abuts the stopper 23 (see FIG. 3*e*), whereby a pasted portion 2*b* (see FIG. 4) is stripped and the fore end 2*a* is drawn out [at this time a bobbin brake (not shown) is released to facilitate the stripping].

Thereafter, the piston 13*a* of the air cylinder 13 is withdrawn, so that the pawl piece 12 pivots away from the inclined surface 3*a* and comes into abutment with the stopper 24. At this time, the fore end 2*a* becomes free (see FIG. 3*f*).

Figure 3G:
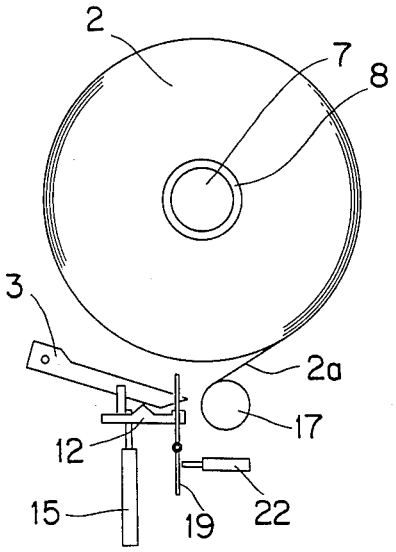

Then, the preliminary suction roller 17 is operated to suck the fore end 2*a* which is now free (see FIG. 3*g*).

Figure 3H:
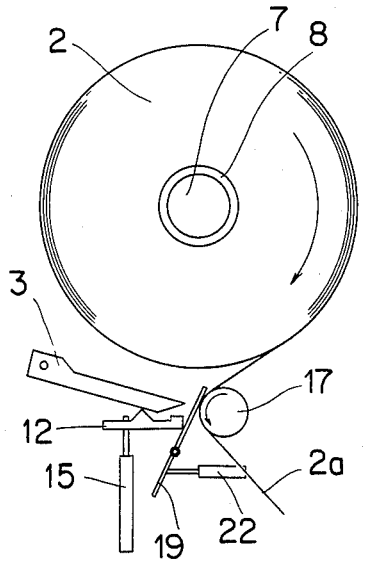

Thereafter, the piston 22*a* of the air cylinder 22 is projected to pivot the spring plate 19 against the resilience of the coil spring 20 and bring it into abutment with the preliminary suction roller 17, whereby the fore end 2*a*is sucked positively by the roller 17 (see FIG. 3*h*). In this state the preliminary suction roller 17 is rotated slowly in the arrowed direction in FIG. 3*h* to send the paper to the cutting and feeding device As set forth hereinabove, the present invention is constructed so that the fore end of a paper roll is stripped by a stripping lever and a pawl member mounted to the stripping lever and then it is sent to the next step by a sucking and delivering means. Therefore, the paper roll can be sent to the next step stably without brakage and such a simple construction assures a less expensive cost of the device.

What is claimed is:

1. A device for automatically stripping and delivering a leading end of a paper roll, said device comprising:

a stripping lever having a fore end movable into and out of contact with the paper roll;

a bobbin driving means for rotating a bobbin with the paper roll wound thereon so that the leading end of the paper roll is rotatable into contact with a fore end portion of said stripping lever;

a pawl member mounted on said stripping lever for movement into and out of contact with the fore end of the stripping lever to grip the leading end of the paper roll conjointly with the fore end of the stripping lever when the paper roll leading end is in contact with the fore end of the stripping lever;

a stripping lever driving means for moving said stripping lever into a first position in abutment with the paper roll and pivoting the stripping lever away from the paper roll into a second position after gripping of the leading end of the paper roll by both the stripping lever and said pawl member occurs;

a sucking and delivering means for sucking the leading end of the paper roll after it is stripped and drawn out away from the roll by both said stripping lever and said pawl member into said second position to enable transferring movement of said leading end from the stripping lever and pawl member to another location; and a stationary base plate to which the stripping lever, bobbin driving means, pawl member, stripping lever driving means and sucking and delivering means are mounted, said first and second positions lying along an arcuate path along which the fore end of the stripping lever moves.

2. The device of claim 1, wherein said stripping lever and pawl member are normally biased apart from each other.

3. A device for automatically stripping and delivering a leading end of a paper roll, said device comprising:

a stripping lever having a fore end movable into and out of contact with the paper roll;

a bobbin driving means for rotating a bobbin with the paper roll wound thereon so that the leading end of the paper roll is rotatable into contact with a fore end portion of said stripping lever;

a pawl member mounted on said stripping lever for movement into and out of contact with the fore end of the stripping lever to grip the leading end of the paper roll conjointly with the fore end of the stripping lever when the paper roll leading end is in contact with the fore end of the stripping lever;

a stripping lever driving means for moving said stripping lever into a first position in abutment with the paper roll and pivoting the stripping lever away from the paper roll into a second position after gripping of the leading end of the paper roll by both the stripping lever and said pawl member occurs;

a sucking and delivering means for sucking the leading end of the paper roll after it is stripped and drawn out away from the roll by both said stripping lever and said pawl member into said second position to enable transferring movement of said leading end from the stripping lever and pawl member to another location; and a stationary base plate to which the stripping lever, bobbin driving means, pawl member, stripping lever driving means and sucking and delivering means are mounted, wherein said stripping lever is pivotally secured at one end thereof to the plate and projects towards the paper roll for tangential contact therein upon being pivoted into an upper position, said pawl member being mounted to the lever fore end at a mid-section of the pawl member for pivotal movement thereabout, and a spring connecting a rear end of the pawl member to a mid-portion of the lever to bias the forward end of the pawl member away from the corresponding forward end of the lever.

4. The device of claim 3, wherein said fore end of the lever has an inclined surface tapered in the direction of the paper roll to constitute a gripping surface on which the leading end of the paper roll is received and clamped thereagainst by the pawl member, and means embedded within the inclined surface for detecting when the leading end of the paper roll contacts said inclined surface, and means actuated by the detecting means for pivoting the forward end of the pawl member into clamping contact with the leading end of the paper roll against said inclined surface.

5. The device of claim 4, wherein said sucking and delivering means includes a suction roller mounted to the base plate adjacent and below the paper roll, said suction roll having a suction surface positioned such that movement of the stripping lever from the upper position to the lower position causes a portion of the paper adjacent the leading end to contact the suction surface of the roller.

6. The device of claim 5, further including a spring plate mounted to the base plate and spring biased away from the suction roller, and piston means for pivoting an end of said spring plate against the suction roller after the leading end of the paper roll is initially brought into abutment with the surface of the suction roller, said spring plate enabling positive suction contact between the roller and paper roll leading end by a pressing action thereagainst.

* * * * *